US006623248B1

(12) United States Patent
Dusemund et al.

(10) Patent No.: US 6,623,248 B1
(45) Date of Patent: Sep. 23, 2003

(54) SYSTEM FOR CONVEYING LIQUIDS WITHOUT PULSING

(75) Inventors: Claus Dusemund, Darmstadt (DE); Klaus Freissler, Stockstadt am Rhein (DE); Wilfried Jammer, Seeheim-Jugenheim (DE); Michael Poth, Darmstadt (DE); Alberto Dix, Griesheim (DE); Eberhard Tempel, Seeheim-Jugenheim (DE)

(73) Assignee: Merck Patent GmbH, Darmstadt (DE)

( * ) Notice: Subject to any disclaimer, the term of this patent is extended or adjusted under 35 U.S.C. 154(b) by 0 days.

(21) Appl. No.: 09/857,692

(22) PCT Filed: Dec. 2, 1999

(86) PCT No.: PCT/EP99/09408

§ 371 (c)(1),
(2), (4) Date: Jun. 8, 2001

(87) PCT Pub. No.: WO00/36329

PCT Pub. Date: Jun. 22, 2000

(30) Foreign Application Priority Data

Dec. 14, 1998 (DE) ..... 198 57 593

(51) Int. Cl.[7] ..... F04F 1/06; F04F 3/00

(52) U.S. Cl. ..... 417/118; 137/14; 137/84; 137/255

(58) Field of Search ..... 417/118, 540, 417/121; 137/115.05, 115.15, 119.01, 207, 84, 255, 256, 1, 14, 208, 209, 112, 263, 265

(56) References Cited

U.S. PATENT DOCUMENTS

| | | | | | |
|---|---|---|---|---|---|
| 1,600,505 | A | * | 9/1926 | Hunter | 417/122 |
| 2,192,727 | A | * | 3/1940 | Courtis et al. | 137/78 |
| 2,372,448 | A | * | 3/1945 | Porteous | 137/68 |
| 2,446,358 | A | | 8/1948 | Yates | 138/30 |
| 3,005,417 | A | * | 10/1961 | Swaney | 103/238 |
| 3,524,714 | A | * | 8/1970 | Grove et al. | 417/345 |
| 4,323,452 | A | * | 4/1982 | Witzenburg | 210/188 |
| 5,148,945 | A | * | 9/1992 | Geatz | 222/1 |
| 5,251,852 | A | * | 10/1993 | Pulkowski et al. | 244/135 C |
| 5,722,447 | A | * | 3/1998 | Morgan et al. | 137/1 |
| 6,019,116 | A | * | 2/2000 | Schell | 137/14 |
| 6,200,104 | B1 | * | 3/2001 | Park | 417/118 |

FOREIGN PATENT DOCUMENTS

| | | | |
|---|---|---|---|
| DE | WO 86/03263 | * | 6/1986 |
| FR | 2381234 | | 9/1978 |
| GB | 1490996 | | 11/1977 |
| WO | 8603263 | | 6/1986 |

* cited by examiner

*Primary Examiner*—Cheryl J. Tyler
*Assistant Examiner*—Han L Liu
(74) *Attorney, Agent, or Firm*—Millen, White, Zelano & Branigan, P.C.

(57) ABSTRACT

A system tot the pulsation-free delivery of liquids, which system may be used for high-purity, liquid chemicals in the semiconductor industry.

19 Claims, 1 Drawing Sheet

SYSTEM FOR CONVEYING LIQUIDS WITHOUT PULSING

Figure 1:
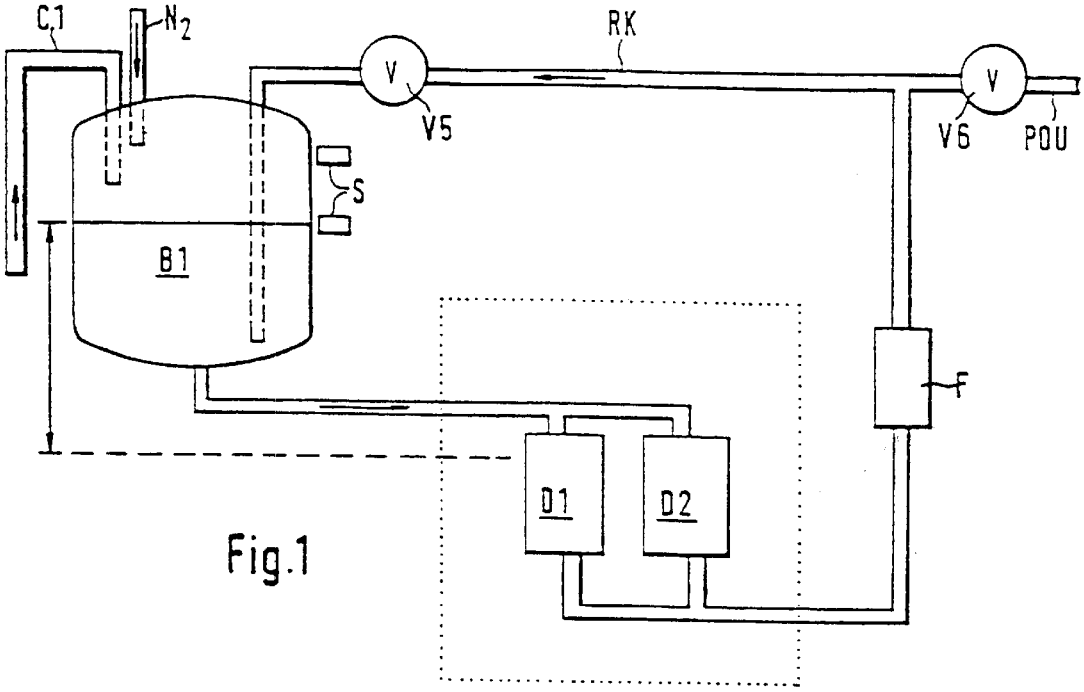

The present invention relates to a system for the pulsation-free delivery of liquids, which system may be used for high-purity, liquid chemicals in the semiconductor industry.

In production processes of the semiconductor industry, high-purity chemicals on which very stringent requirements with regard to freedom from particles are imposed are normally used. Since the chemicals used are frequently highly corrosive or oxidizing substances, correspondingly high demands are made on the purity or resistance of the materials coming into contact with the chemicals. Especially critical in this connection with regard to the release of particles are locations at which the chemicals come into contact with moving parts in the system. The requirements imposed on the freedom from particles are constantly increasing and hitherto known arrangements cannot fulfill these new requirements in a satisfactory manner.

The object of the present invention was therefore to provide a system which has as few moving parts as possible, such as, for example, pumps.

The object is achieved by a liquid-delivery system for pulsation-free delivery, which liquid-delivery system delivers liquids in a recirculation circuit and has at least one intermediate tank.

At least two small pressure tanks connected in parallel are incorporated in this system according to the invention, and these pressure tanks deliver the liquid chemicals to the storage tank by means of a pressure difference and replace a pump.

Of these two small pressure tanks (D1, D2) connected in parallel, one is filled by means of a pump, whereas the other is pressurized with a positive pressure compared with the storage tank (B1) and delivers the liquid, starting from it, in the circuit, the control of the liquid flow being effected by electrically controllable valves.

Characteristic of this delivery system is the fact that the small tank (D1 or D2) which has the higher pressure hats a positive pressure of 2 to 6 bar, and that the two small tanks of the plant are alternately pressurized during operation, as a result of which a continuous liquid flow is produced.

According to the invention, the object is achieved in that one of the small tanks (D1 or D2) connected in parallel, in the filled state, has a pressure which results from a height difference of at least 0.5 m between the storage tank (B1) and the height of the small tanks, which are located at a lower level than the storage tank. Accordingly, the object is achieved in that in each case one of the small pressure tanks is filled from the storage tank connected to it on account of a pressure difference, which results from a height difference of at least 0.5 m between the storage tank and The pressure tanks, which are connected in parallel and are located at a lower level than the storage tank, whereas the other small pressure tank is pressurized with a positive pressure and the liquid, starting from it, is delivered in the circuit, the control of the liquid flow being effected by electronically controllable valves.

In a particular embodiment, one of the small tanks connected in parallel is pressurized with a pressure which results from a height difference of 1 m between the storage tank and the two tanks connected in parallel.

According to the invention, the pressure tanks may be filled from the storage tank by the liquid being delivered into the pressure tanks through communicating pipelines by means of a slight positive pressure.

At the end of the recirculation circuit (RK) of the delivery system, the pressure is reduced to the internal pressure of the storage tank (B1).

This pressure reduction may be effected by a valve, an orifice or a pipe constriction.

The object of this invention may be achieved in particular by a delivery system whose storage tank has a positive pressure greater than or equal to 0.05 bar, the small pressure tanks being designed as tanks for high pressure.

In the entire recirculation circuit, the pressure drops as a function of the delivery flow. The residual pressure, as mentioned above, may be reduced to the internal pressure of the storage tank by a valve, an orifice or a pipe constriction.

The liquid-delivery system according to the invention permits the delivery of liquids in a recirculation circuit, only one large storage tank (day tank) being required.

A special advantage of this delivery system is that a pump may be replaced by two small pressure tanks connected fin parallel. These pressure tanks may have in particular a volume of 1–200 l. Whereas one pressure tank is filled by the pressure difference which results from the static height difference (>0.5 m) between the storage tank (B1) and the pressure tanks (D1, D2) or by means of a pump, the other pressure tank, by application of a higher positive pressure (2–6 bar) relative to the storage tank, delivers the liquid in the circuit. This can be effected by corresponding operation of electronically controllable valves. At the end of the recirculation circuit, the pressure is reduced to the internal pressure of the storage tank B1 by means of a valve, an orifice or a pipe constriction. The filling of the storage tank from outside may be effected by means of pumps (semi-pumping system) or also by pressure (pressure system).

The filling of the pressure tanks D1 and D2 respectively from the storage tank B1 can also be effected by a slight positive pressure in B1 (>0.05 bar) (see above). In this case, however, B1 must comply with the pressure-tank ordinance.

The construction described here of the delivery system according to the invention results in the following advantages over conventional systems:

The system combines the advantages of pumping systems, by which a larger pressure tank may be dispensed with, with those of the pressure systems. The latter are distinguished by a continuous flow and by the absence of movable wear parts. This system is advantageous in use as a supply system for electronics chemicals, since, in particular in the particle reduction, marked improvements compared with pumping systems have been found. Another substantial advantage over known supply systems is the low-pulsation mode of operation of the entire system.

Furthermore, this system is considerably less expensive than other conventional pressure systems in which, for example, work is carried out with two large storage tanks (pressure tanks, >3 bar), since here only a pressureless storage tank and two small pressure tanks (>2 bar) are required.

The continuous, uniform liquid flow produced by the system is associated with a particle reduction. As a result, filters fitted in the circuit work more effectively, since this system, in contrast to systems constructed with diaphragm or bellows pumps, runs in a pulsation-free manner. The pressure at the extraction points (POU) is also not subjected to any pulsation and can be kept very stable.

A very special advantage of the system according to the invention consists in the reduction of mechanically movable parts:

The delivery system, apart from the valves, has no movable parts. Pumps may be dispensed with within the recirculation circuit. In this way, the system is markedly more reliable in operation with regard to susceptibility to trouble. Less service is required and fewer outages, during which wear parts, such as, for example, pump parts have to be exchanged, occur.

Since the liquid is not delivered by the mechanically movable parts of the pump, such as, for example, in the bellows pump or in the diaphragm or centrifugal pumps, fewer particles are released into the liquid, a factor which is of particular importance during the delivery of electronics chemicals.

If the system according to the invention is compared with conventional pumping systems, the following advantages are accordingly obtained:

During the use of pumping systems having a recirculation circuit, the pumps, in the semiconductor industry, are in operation round the clock (typical value: 99.9% up-time per annum). During this continuous use, and in addition often in the presence of very aggressive chemicals, the pumps require constant maintenance. In order to avoid interruptions in the chemical delivery, the pumps must always be of redundant design, i.e., in the event of a malfunction, parallel pumps which can be switched on automatically in replacement must be available.

In comparison, the semi-pumping system according to the invention has substantially fewer wear parts and the maintenance cost is correspondingly lower.

Furthermore, virtually only compressed-air pumps, i.e. diaphragm and bellows pumps, made of plastic (usually PTFE) are still used by the semiconductor industry. These pumps cause more or less pronounced pulsations in the liquid to be delivered (pressure fluctuations), which markedly reduces the filtration performance of diaphragm filters. In addition, as already mentioned above, mechanically movable parts of the pumps (valves, diaphragm, bellows) release undesirable particles into the medium to be delivered.

Compared with vacuum/pressure systems, the system according to the invention has the following advantages:

To fill the pressure tanks in vacuum/pressure systems, it is necessary to apply a vacuum, as a result of which the liquid chemicals are delivered from a storage lank into the pressure or vacuum tanks. This principle is limited by the delivery capacity of the vacuum pump capacity [sic]. Also, only a very weak vacuum can be applied when using saturated solutions of gases (e.g. $NH_4OH$ 28%, HCI 36% etc.), since otherwise emission of gases is caused, which would be associated with a change in concentration.

For better understanding and for clarification, a flow scheme of such a delivery system is given below by way of example and is within the scope of protection of the present invention, but is not suitable for restricting the invention to this example.

Figure 2:
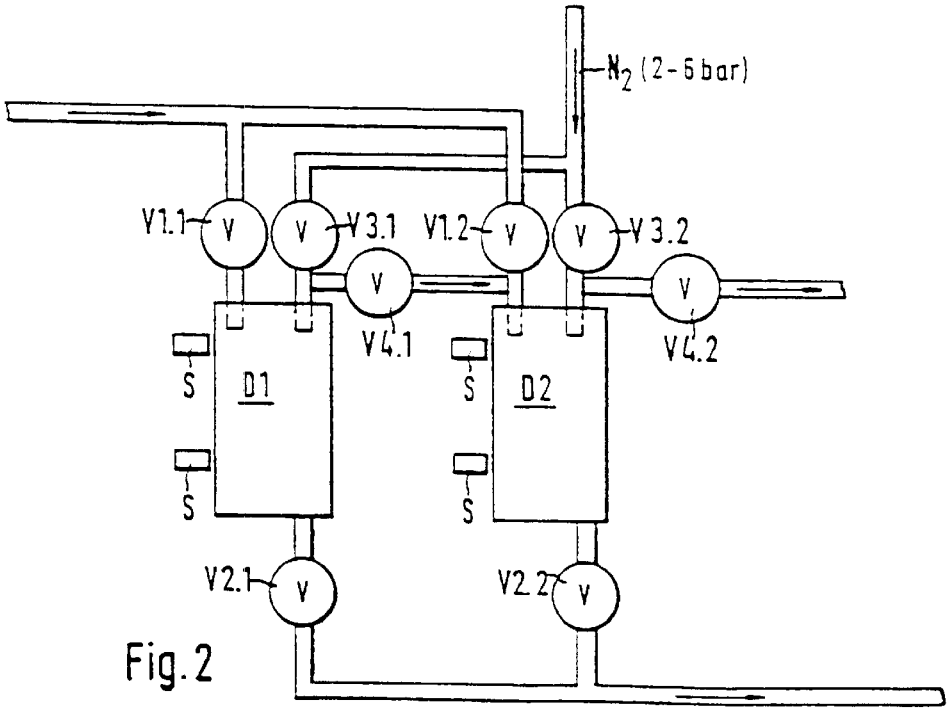

FIG. 1 shows a sketch of a chemical-delivery or chemical-supply system with a chemical-recirculation unit, in which B1 represents a storage tank or mixing tank, which can be filled by pumps or pressure. B1 and the pressure tanks D1 and D2 are located at different levels, so that a minimum static height difference, which is sufficient in order to fill the pressure tank, is obained between the filling level of $D1_{max}$ $(D2)_{max}$ and the tank $B1_{min}$. FIG. 2 shows a pump unit with which the delivery system according to the invention can be provided. FIG. 2 is a detail of FIG. 1.

| | |
|---|---|
| C1 | Chemical-feed line (from mixing and transport tank) |

-continued

| | |
|---|---|
| RK | Recirculation circuit |
| B1 | Storage tank (day tank) |
| D1, D2 | Pressure tanks (5 to 200 l, up to 6 bar) |
| V1.1, V1.2 | Filling valves |
| V2.1, V2.2 | Valves on the pressure side |
| V3.1, V3.2 | $N_2$-inlet valves |
| V4.1, V4.2 | $N_2$-vent valves |
| V5 | Valve for controlling the rate of flow or the throughflow |
| V6 | Valve for the POU |
| POU | Point of use |
| F | Filtration elements |
| S | Filling-level sensor (optional) |

What is claimed is:

1. A liquid delivery system comprising a storage tank connected in series with two pressurized tanks, which are in line parallel to each other, wherein one of the pressurized tanks is pressurized with a positive pressure compared with the storage tank, a pump to fill the pressurized tank that is not pressurized with a positive pressure compared with the storage tank, and wherein a re-circulation line is connected from the pressurized tanks to the storage tank.

2. A liquid delivery system according to claim 1, further comprising electrically controllable valves to control to flow of liquid from the pressurized tanks to the re-circulation line.

3. A liquid delivery system according to claim 1, wherein the pressurized tanks are alternately pressurized.

4. A liquid delivery system according to claim 1, wherein in the re-circulation line, the pressure is reduced to the pressure of the storage tank.

5. A liquid delivery system according to claim 4, wherein in the re-circulation line, the pressure is reduced to the pressure of the storage tank by a valve, an orifice or a pipe constriction.

6. A liquid delivery system comprising a storage tank connected in series with two pressurized tanks, which are in line parallel to each other, wherein one of the pressurized tanks is pressurized with a positive pressure compared with the storage tank, wherein a recirculation line is connected from the pressurized tanks to the storage tank, and wherein the pressurized tank that is pressurized with a positive pressure compared with the storage tank is pressurized with a positive pressure of 2 to 6 bars.

7. A liquid delivery system according to claim 6, wherein in the re-circulation line, the pressure is reduced to the pressure of the storage tank.

8. A liquid delivery system comprising a storage tank connected in series with two pressurized tanks, which are in line parallel to each other, wherein one of the pressurized tanks is pressurized with a positive pressure compared with the storage tank, wherein a re-circulation line is connected from the pressurized tanks to the storage tank, and wherein the pressurized tank that is pressurized with a positive pressure compared with the storage tank is pressurized by a height difference between the storage tank and said pressurized tank, which is located at an elevation lower than the storage tank.

9. A liquid delivery system according to claim 8, wherein the pressurized tanks are located at an elevation of at least 0.5 meters lower than the storage tank.

10. A liquid delivery system according to claim 9, wherein the pressurized tanks are located at an elevation of 0.5–1 meters lower than the storage tank.

11. A liquid delivery system according to claim 8, wherein in the re-circulation line, the pressure is reduced to the pressure of the storage tank.

12. A liquid delivery system comprising a storage tank connected in series with two pressurized tanks, which are in line parallel to each other, wherein one of the pressurized tanks is pressurized with a positive pressure compared with the storage tank, wherein a re-circulation line is connected from the pressurized tanks to the storage tank, and wherein the pressurized tank that is not pressurized with a positive pressure compared with the storage tank is filled from the storage tank.

13. A liquid delivery system according to claim 12, wherein the pressurized tank that is not pressurized with a positive pressure compared with the storage tank is filled from The storage tank by means of a positive pressure.

14. A liquid delivery system according to claim 12, wherein the pressurized tank that is not pressurized with a positive pressure compared with the storage tank is filled from the storage tank by means of gravity.

15. A liquid delivery system according to claim 12, wherein in the re-circulation line, the pressure is reduced to the pressure of the storage tank.

16. A liquid delivery system comprising a storage tank connected in series with two pressurized tanks, which are in line parallel to each other, wherein one of the pressurized tanks is pressurized with a positive pressure compared with the storage tank, wherein a re-circulation line is connected from the pressurized tanks to the storage tank, and wherein the storage tank has a pressure of at least 0.05 bar.

17. A liquid delivery system comprising a storage tank connected in series with two pressurized tanks, which are in line parallel to each other, wherein one of the pressurized tanks is pressurized with a positive pressure compared with the storage tank, wherein a recirculation line is connected from the pressurized tanks to the storage tank, and wherein the pressure tanks, each independently, have a volume of 1 to 200 liters.

18. A liquid delivery system comprising a storage tank connected in series with two pressurized tanks, which are in line parallel to each other, wherein one of the pressurized tanks is pressurized with a positive pressure compared with the storage tank, wherein a re-circulation line is connected from the pressurized tanks to the storage tank, and further comprising a filter.

19. A liquid delivery system comprising a storage tank connected in series with two ,pressurized tanks, which are in line parallel to each other, wherein one of the pressurized tanks is pressurized with a positive pressure compared with the storage tank, wherein a re-circulation line is connected from the pressurized tanks to the storage tank, and wherein the storage tank is filled by a pump or by a pressure system.

* * * * *